US009890962B2

(12) United States Patent
Lee et al.

(10) Patent No.: US 9,890,962 B2
(45) Date of Patent: Feb. 13, 2018

(54) REFRIGERANT SOCKET AND AIR CONDITIONER HAVING THE SAME

(71) Applicant: DELTA ELECTRONICS, INC., Taoyuan County (TW)

(72) Inventors: Chien-Chung Lee, Taoyuan County (TW); Yuan-Ping Hsieh, Taoyuan County (TW); Hsu-Fan Ai, Taoyuan County (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 275 days.

(21) Appl. No.: 14/632,737

(22) Filed: Feb. 26, 2015

(65) Prior Publication Data

US 2015/0354842 A1 Dec. 10, 2015

(30) Foreign Application Priority Data

Jun. 6, 2014 (TW) ..... 103119662 A

(51) Int. Cl.
*F25B 41/00* (2006.01)
*F25B 27/00* (2006.01)
(Continued)

(52) U.S. Cl.
CPC ..... *F24F 1/32* (2013.01); *Y10T 137/9029* (2015.04)

(58) Field of Classification Search
CPC . F24F 1/32; F25B 2313/006; F25B 2313/007; F25B 41/003; F25B 41/043; F25B 49/02
See application file for complete search history.

(56) References Cited

U.S. PATENT DOCUMENTS 6,158,229 A * 12/2000 Aizawa ..... F25B 41/003 62/298
6,839,966 B2 * 1/2005 Kakinuma ..... F16L 41/03 29/237
(Continued)

FOREIGN PATENT DOCUMENTS

CN 1955587 5/2007
CN 101178274 5/2008
(Continued)

OTHER PUBLICATIONS

Office Action dated Jul. 14, 2016 from corresponding application No. TW 103119662.
(Continued)

*Primary Examiner* — Henry Crenshaw
(74) *Attorney, Agent, or Firm* — Hauptman Ham, LLP

(57) ABSTRACT

A refrigerant socket includes an accommodating body and a pipeline assembly. The pipeline assembly includes a refrigerant pipe connecting to the accommodating body and having an inner section inside the accommodating body and an outer section outside the accommodating body; a switch placed at the inner section and away from a free end thereof, the switch being used to selectively allow or block a flow inside the refrigerant pipe; a refrigerant pumping pipe communicating between the free end of the inner section and the switch; and at least one joint communicates between the free end of the inner section and the switch. Therefore, even if the diameter of the refrigerant pipe does not match an air conditioner indoor unit, connection can still be made without the need of removing the original piping, thereby avoiding wasting refrigerant.

21 Claims, 10 Drawing Sheets

(51) Int. Cl.

| | |
|---|---|
| ***B21D 51/16*** | (2006.01) |
| ***E03B 7/07*** | (2006.01) |
| ***F24F 1/32*** | (2011.01) |

(56) References Cited

U.S. PATENT DOCUMENTS

| | | | | |
|---|---|---|---|---|
| 2009/0049855 | A1* | 2/2009 | Murata | F24F 1/26<br>62/259.1 |
| 2011/0219803 | A1* | 9/2011 | Park | F24F 1/26<br>62/238.6 |
| 2012/0000230 | A1* | 1/2012 | Matsuura | F24F 1/26<br>62/259.1 |
| 2012/0211209 | A1* | 8/2012 | Choi | F16L 19/086<br>165/178 |

FOREIGN PATENT DOCUMENTS

| | | | | |
|---|---|---|---|---|
| CN | 202546935 U | * | 11/2012 | F24F 1/00 |
| JP | H1163565 | | 3/1999 | |

OTHER PUBLICATIONS

Office Action dated Jun. 29, 2017 from corresponding application No. CN 201410251121.3.

* cited by examiner

REFRIGERANT SOCKET AND AIR CONDITIONER HAVING THE SAME

BACKGROUND

1. Technical Field

The present invention relates to a socket and, in particular, to a refrigerant socket and an air conditioner having the same. The refrigerant socket is connected between an outdoor unit and an indoor unit of the air conditioner.

2. Related Art

An air conditioner includes an outdoor unit, a plurality of indoor units, and a plurality of refrigerant pipes connected between the outdoor unit and the indoor unit. The indoor unit is installed indoors to performing heat exchange on indoor air. The outdoor unit is installed outdoors to draw outdoor air and release heat.

When installing the conventional air conditioner, a diameter of the installed refrigerant pipe has to exactly match the outdoor unit and the indoor unit. Therefore, if a room with the installed indoor unit is intended for a different use, a cooling capacity is changed, decoration is changed, brand-new decoration is required, a position of the indoor unit is changed, or etc., the original piping has to be removed to conduct a new installation, there occur problems like wasting piping materials, refrigerant, time, and efforts for the new installation, so the new installation not only is cost-prohibitive and cost-ineffective, but also damages the structure of the building by repeatedly removing and installing the piping. Further, if the refrigerant pipe is already installed in a wall, the wall has to be damaged for installing new piping, so the installation is more troublesome and inconvenient and greatly damaging the structure of the building, which are defects commonly known by people.

BRIEF SUMMARY

It is an object of the present invention to provide a refrigerant socket and an air conditioner having the same. Even if a diameter of a refrigerant pipe does not match an indoor unit, connection can still be made without the need of removing the original piping, thereby avoiding wasting refrigerant.

Accordingly, the present invention provides a refrigerant socket including: an accommodating body including an accommodating space; and at least one pipeline assembly including a refrigerant pipe, a switch, a refrigerant pumping pipe, and at least one joint. The refrigerant pipe is connected to the accommodating body and has an inner section inside the accommodating space and an outer section outside the accommodating body. The inner section has a free end. The switch is disposed at the inner section and away from the free end thereof. The switch selectively allows or blocks a flow inside the refrigerant pipe. The refrigerant pumping pipe communicates between the free end of the inner section and the switch. The at least one joint communicates between the free end of the inner section and the switch.

The present invention further provides a conditioner including an outdoor unit, at least one indoor unit including an indoor unit refrigerant pipe, and at least one refrigerant socket. The at least one refrigerant socket includes: an accommodating body, the accommodating body having an accommodating space; at least one pipeline assembly. The pipeline assembly includes a refrigerant pipe, a switch, a refrigerant pumping pipe, and at least one joint. The refrigerant pipe is connected to the accommodating body and has an inner section inside the accommodating space and an outer section outside the accommodating body. The inner section has a free end, and the outer section is connected to the outdoor unit. The switch is disposed at the inner section and away from the free end thereof, and the switch selectively allows or blocks a flow inside the refrigerant pipe where the switch is. The refrigerant pumping pipe communicates between the free end of the inner section and the switch. The at least one joint communicates between the free end of the inner section and the switch, and the indoor unit refrigerant pipe of the at least one indoor unit is connected to the at least one joint.

Compared to conventional techniques, the present invention has following effects: even if the diameter of the refrigerant pipe does not match the indoor unit, connection can still be made by means of the refrigerant socket without the need of removing the original piping, thereby avoiding wasting refrigerant.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 7:
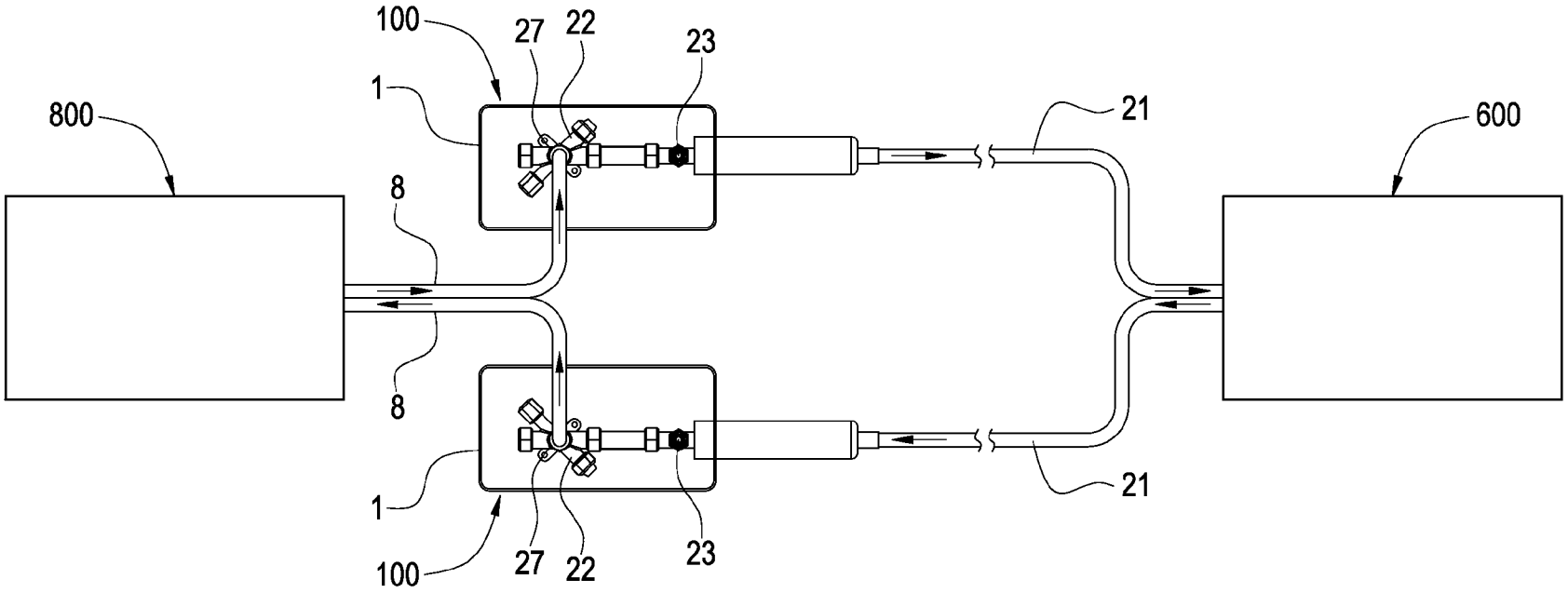
FIG. 7 is a schematic view illustrating the connection of an air conditioner using the refrigerant socket shown in FIG. 6 according to the present invention.

The present invention provides a refrigerant socket and an air conditioner having the same. The air conditioner includes an outdoor unit 600 (as shown in FIG. 7), an indoor unit 800, and a refrigerant socket 100. The refrigerant socket 100 is connected between the outdoor unit 600 and the indoor unit 800 to allow refrigerant in liquid phase from the outdoor unit 600 to be conveyed into the indoor unit 800. After heat exchange, the refrigerant in vapor phase is conveyed from the indoor unit 800 back into the outdoor unit 600.

Please refer to FIGS. 1 to 5, showing the refrigerant socket 100 according to the first embodiment of the present invention. The refrigerant socket 100 includes an accommodating body 1 and a plurality of pipeline assemblies 2. In the first embodiment, the number of the pipeline assemblies 2 is two as an example (the refrigerant socket 100 certainly may include only one, three, or more than three pipeline assemblies 2), and detailed descriptions are provided as follow.

The accommodating body 1 includes a box body 11, a cover body 12, and a partition 13. The box body 11 has an accommodating space 111, and the box body 11 forms an opening 110 corresponding to the accommodating space 111. The cover body 12 correspondingly covers the opening 110 of the box body 11. The partition 13 is elevated high to be disposed at a suitable height inside the accommodating space 111 of the box body 11 and forms as a close shape. The partition 13 further forms a plurality of holes 131. The accommodating body 1 can be embedded in a depression (not illustrated) of the wall, and then the cover body 12 or the partition 13 can cover the accommodating space 111 for a decoration effect. Certainly, the accommodating body 1 can also be protrudingly installed on the wall, which is not limited by the present invention. An insulation material 14 (not shown in some of the drawings) is disposed in the accommodating space 111 of the accommodating body 1 to keep the accommodating body 1 cool.

The pipeline assembly 2 includes a refrigerant pipe 21, a refrigerant pumping pipe 22, a switch 23, and a plurality of joints (for example, joints 24, 25, 26 or even more). In the first embodiment, each of the pipeline assemblies 2 has a plurality of joints 24 to 26, as exemplified. The refrigerant pipe 21 is connected to the accommodating body 1 and has an inner section 211 inside the accommodating space 111 and an outer section 212 outside the accommodating body 1. The inner section has a free end 210. Referring to FIG. 7, the outer section 212 of the two pipeline assemblies 2 is connected to a refrigerant outlet and a refrigerant inlet (not shown in the drawings) of the outdoor unit 600, respectively. The outer section 212 of the refrigerant pipe 21 is enclosed by an insulation material 28 to maintain cool in the refrigerant pipe 21.

The switch 23 is disposed at the inner section 211 and away from the free end 210. The refrigerant pumping pipe 22 communicates between the free end 210 of the inner section 211 and the switch 23. The switch 23 is a stop valve, so as to selectively allow or block the flow inside the refrigerant pipe 21, thereby controlling the refrigerant inside the refrigerant pipe 21 to flow or not to flow.

Figure 5:
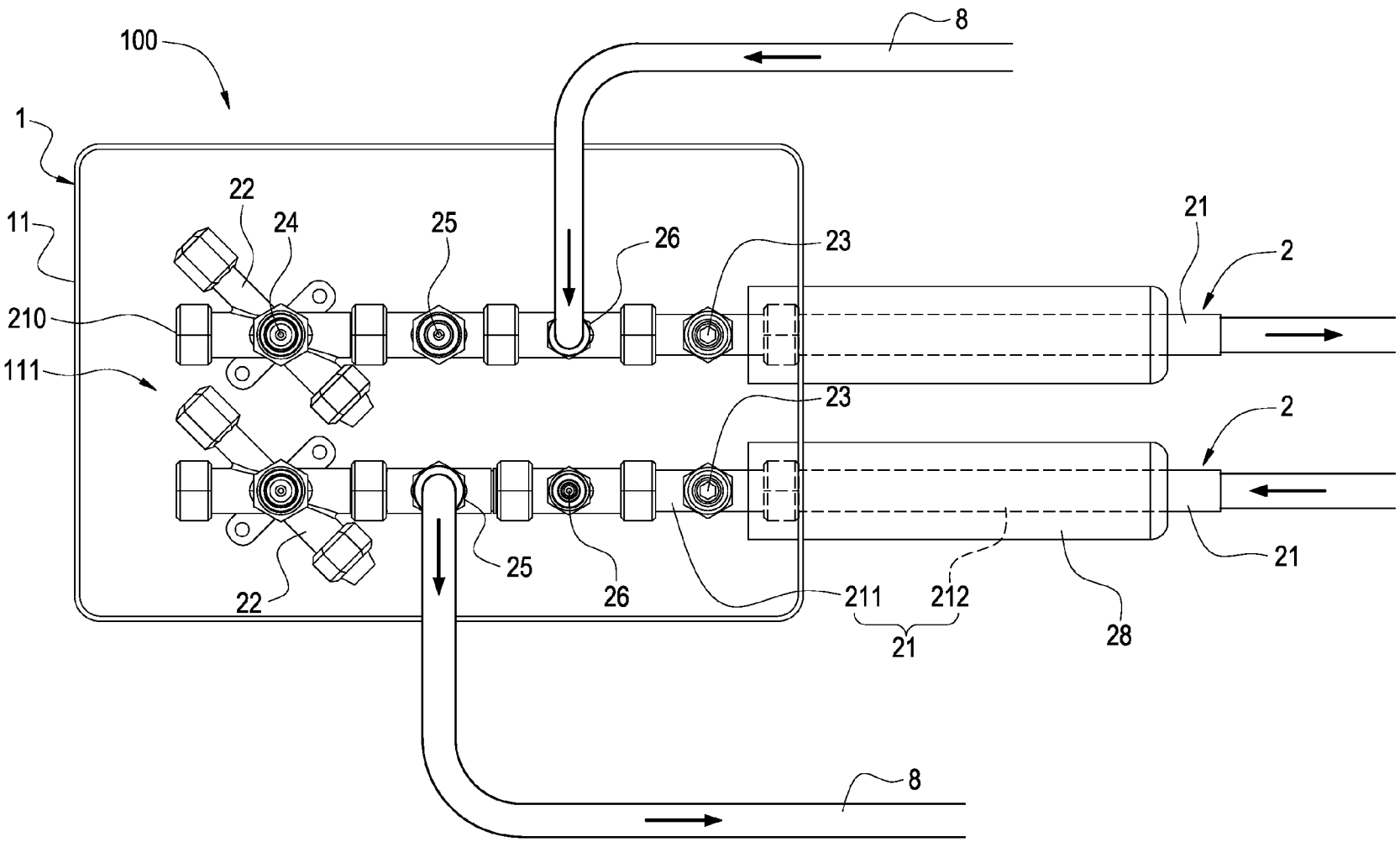
FIG. 5 is a schematic view of the refrigerant socket, showing a flow state of the refrigerant after connecting the indoor unit refrigerant pipe, according to the first embodiment of the present invention.

Each of the joints 24, 25 and 26 communicates between the free end 210 of the inner section 211 and the switch 23, and has a different diameter for being adapted to use with different outdoor units 600 and indoor units 800. As shown in the drawings, the diameter of the joint 24 is larger, the diameter of the joint 26 is smaller, and the diameter of the joint 25 is between that of the joint 24 and that of the joint 26. For instance, the diameters of the joints 24 to 26 can sequentially be ½ inch, ⅜ inch, and ¼ inch, or can be greater diameters like ¾ inch, ⅝ inch, and ½ inch. A workman can select suitable joints from joints 24 to 26 to match the diameters of the outdoor unit 600 and the indoor unit 800. Therefore, even if the diameter of the refrigerant pipe 21 does not match the indoor unit 800, the connection can still be made via the refrigerant socket 100 of the present invention. Referring to FIG. 5, two indoor unit refrigerant pipes 8 (one is for flowing in, and the other is for flowing out) of the indoor unit 800 (not shown in FIG. 5, but shown in FIG. 7) are respectively and selectively connected to one of the joints 24 to 26 of the two pipeline assemblies 2.

Figure 1:
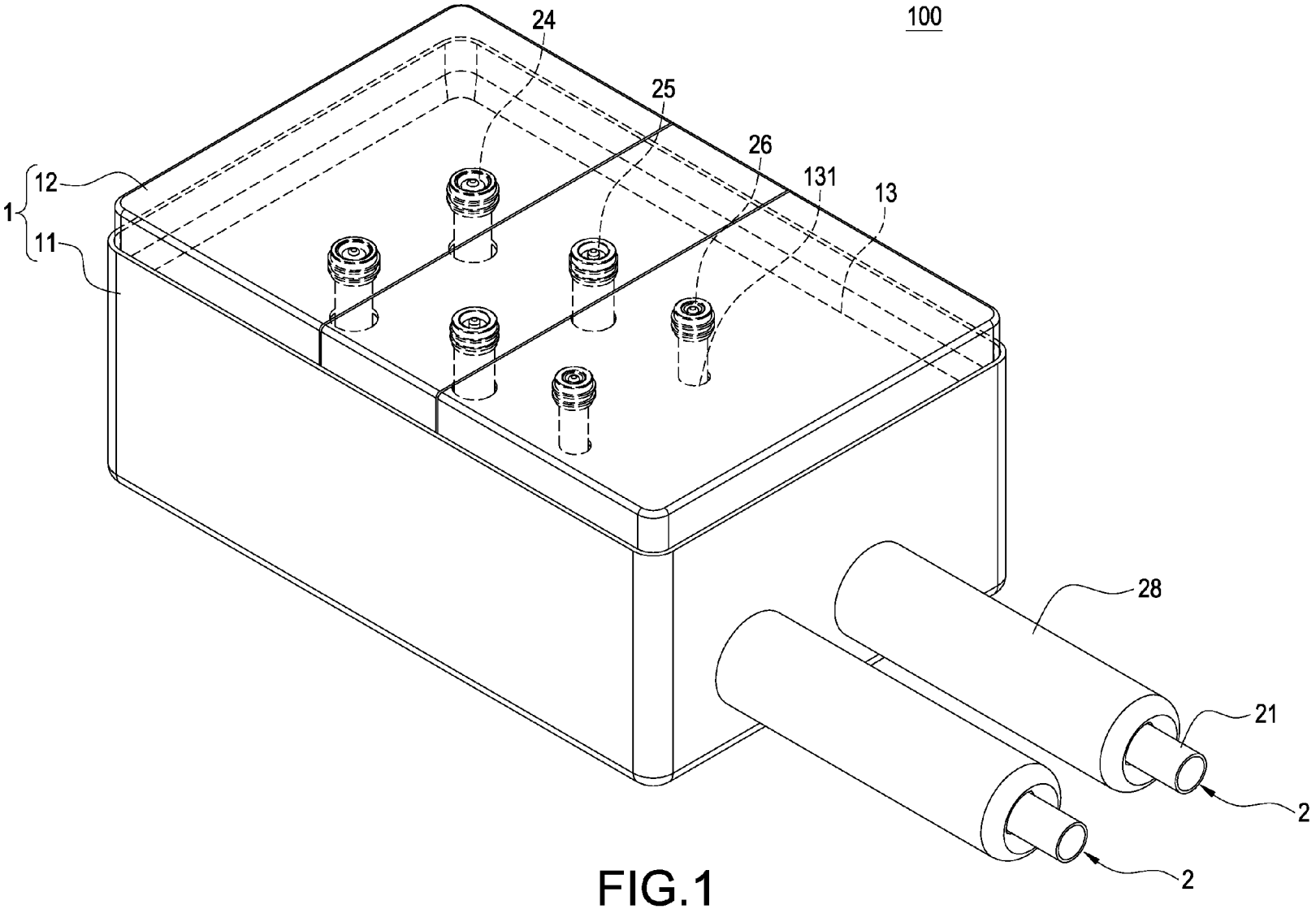
FIG. 1 is a perspective view of a refrigerant socket according to the first embodiment of the present invention.
Figure 2:
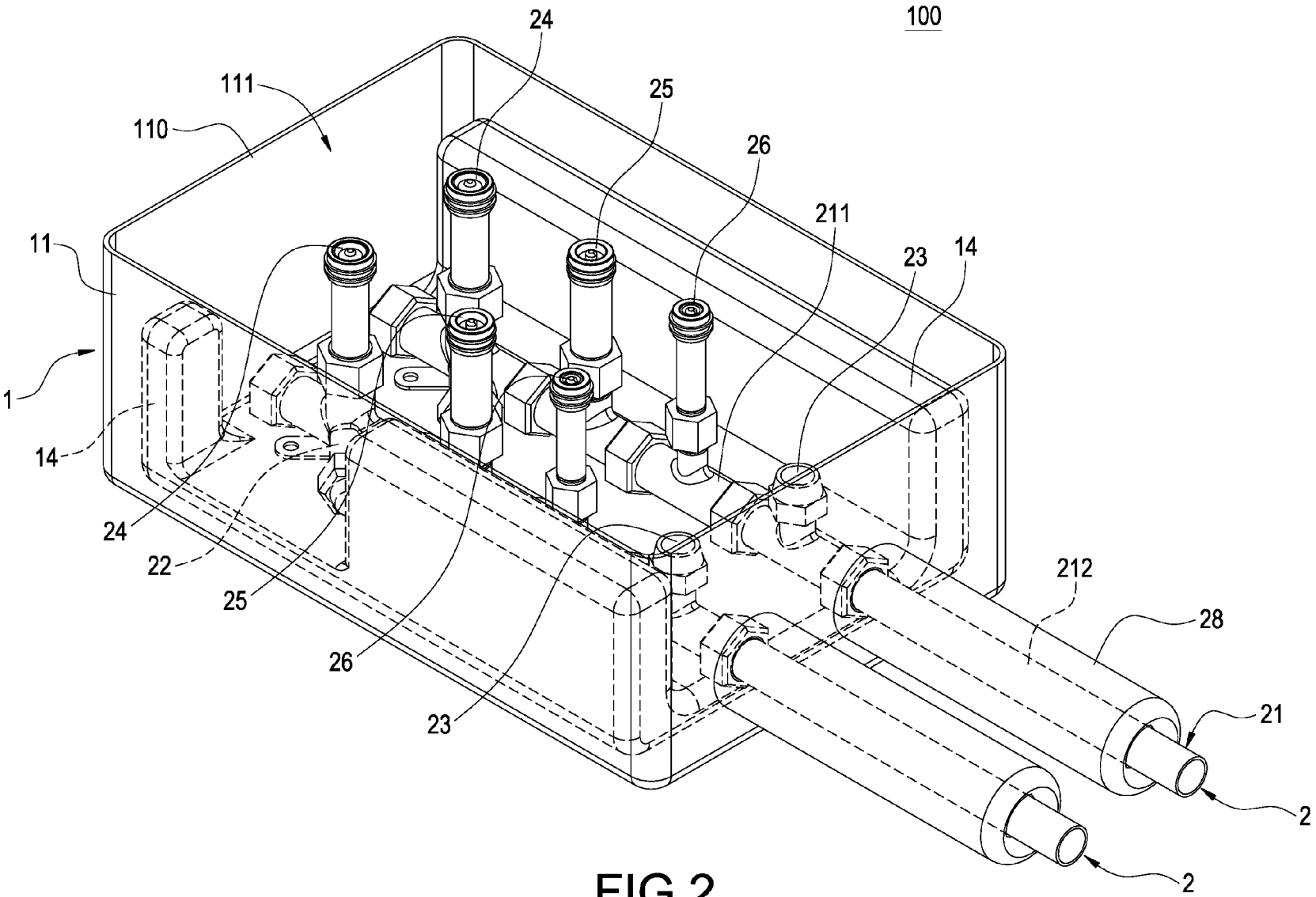
FIG. 2 is a perspective view of the refrigerant socket, after a cover body and a partition are opened, according to the first embodiment of the present invention.
Figure 3:
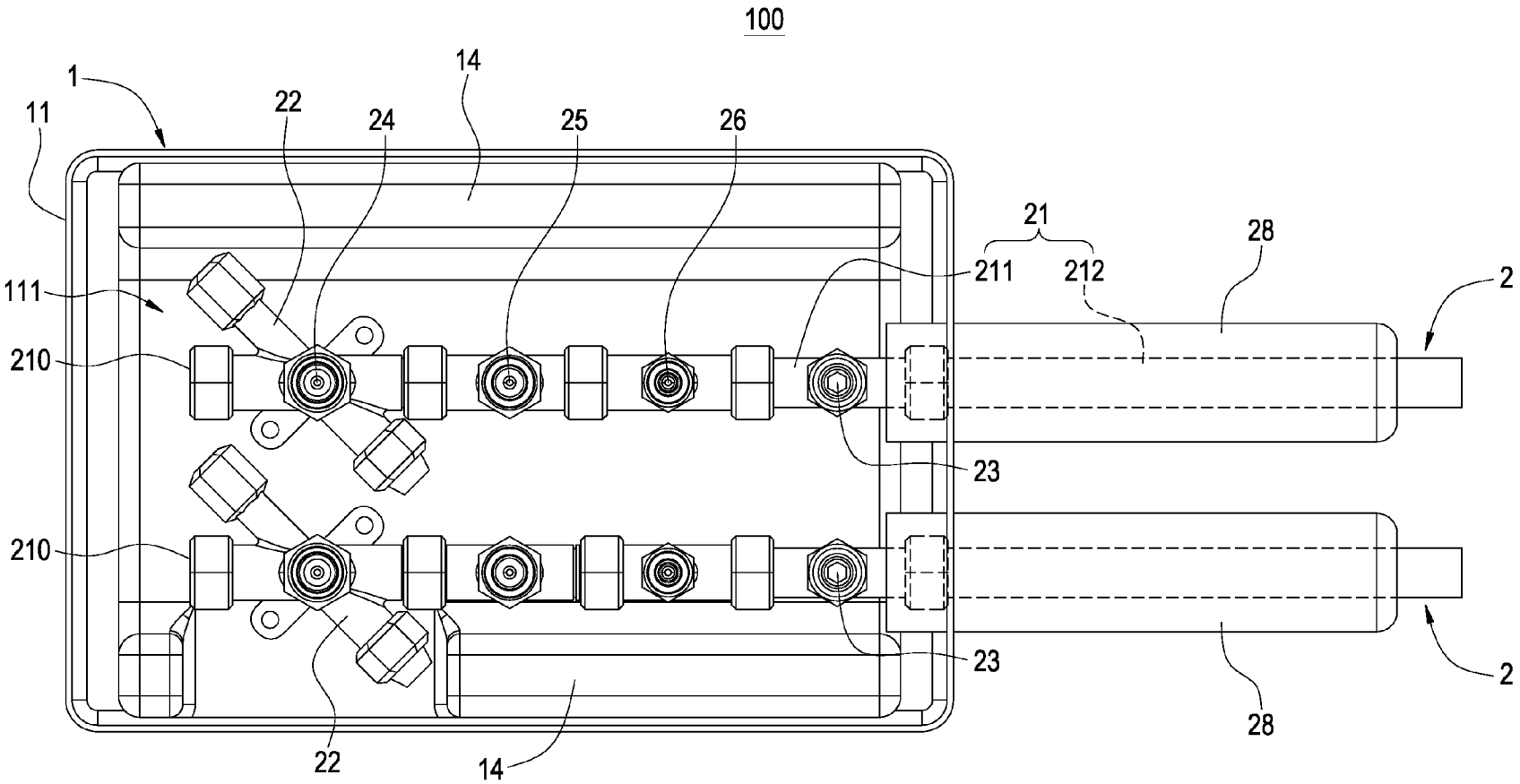
FIG. 3 is a front view of the refrigerant socket of FIG. 2 according to the first embodiment of the present invention.
Figure 4:
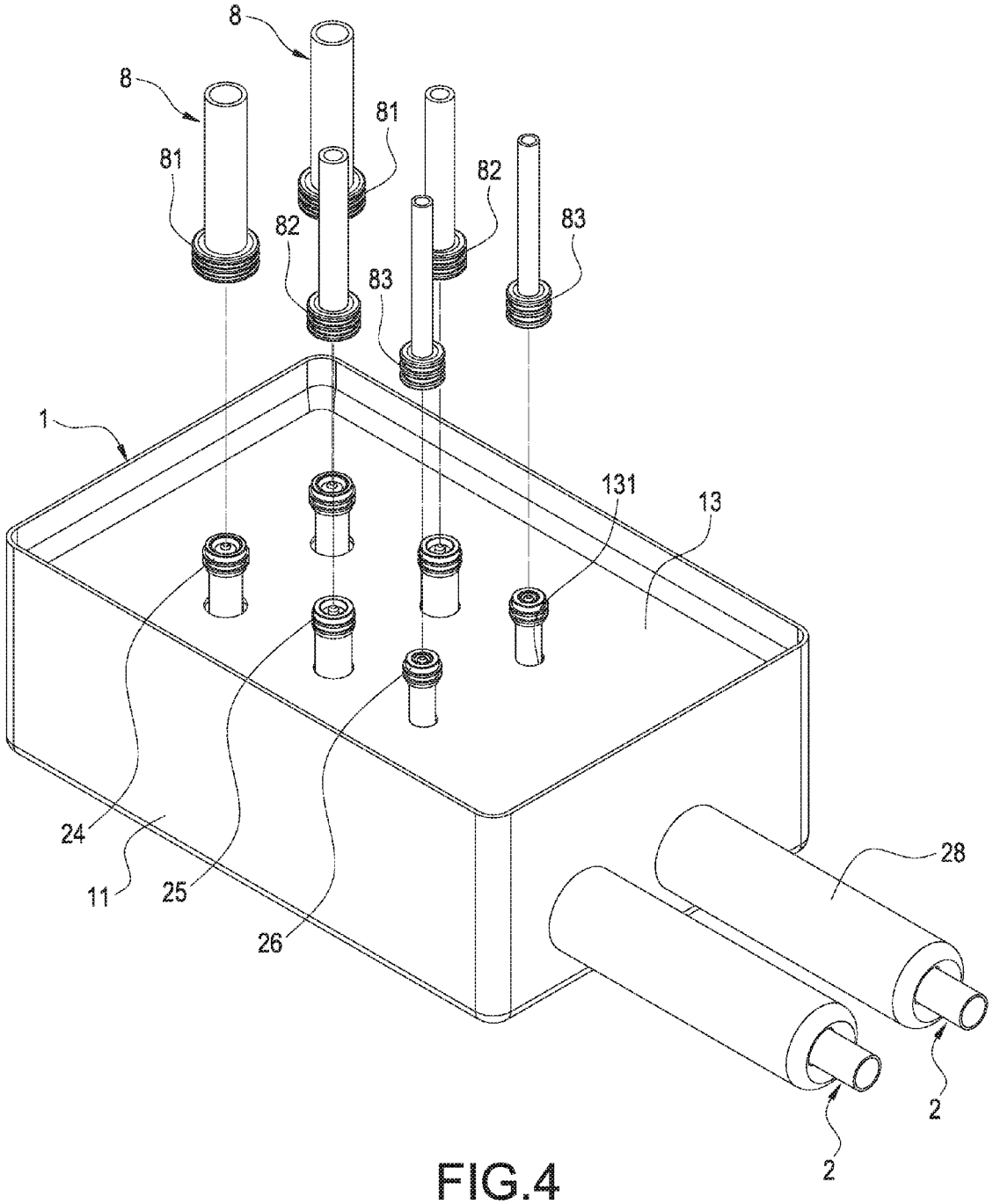
FIG. 4 is a schematic perspective view of the refrigerant socket, after opening a cover body for connecting an indoor unit refrigerant pipe, according to the first embodiment of the present invention.

As shown in FIG. 4, each of the joints 24, 25 and 26 protrudes outside the accommodating body 1 through the holes 131 of the partition 13. The indoor unit refrigerant pipe 8 of the indoor unit 800 has butt joints 81, 82, and 83 removably connected to the joints 24, 25, and 26, respectively.

Referring to FIGS. 5 and 7, the refrigerant socket 100 has two pipeline assemblies 2. The two pipeline assemblies 2 are respectively used as a refrigerant flowing in pipe and a refrigerant flowing out pipe while installed to the indoor unit 800. Since each of pipeline assemblies 2 has plural joints 24 to 26, the workman can select a suitable one (what shown in FIG. 5 are joint 25 and joint 26 respectively) of the joints to match and connect to the indoor unit 800. The installation is very convenient and fast.

Moreover, the refrigerant pumping pipe 22 is connected to the inner section 211 and close to the free end 210, and the refrigerant pumping pipe 22 is correspondingly connected to the joint 24 closest to the free end 210. The refrigerant pumping pipe 22 is a three-way pipe, and the workman can use the refrigerant pumping pipe 22 to pump out the refrigerant inside the indoor unit refrigerant pipe 8 or the refrigerant pipe 21 to substantially achieve a vacuum.

Figure 6:
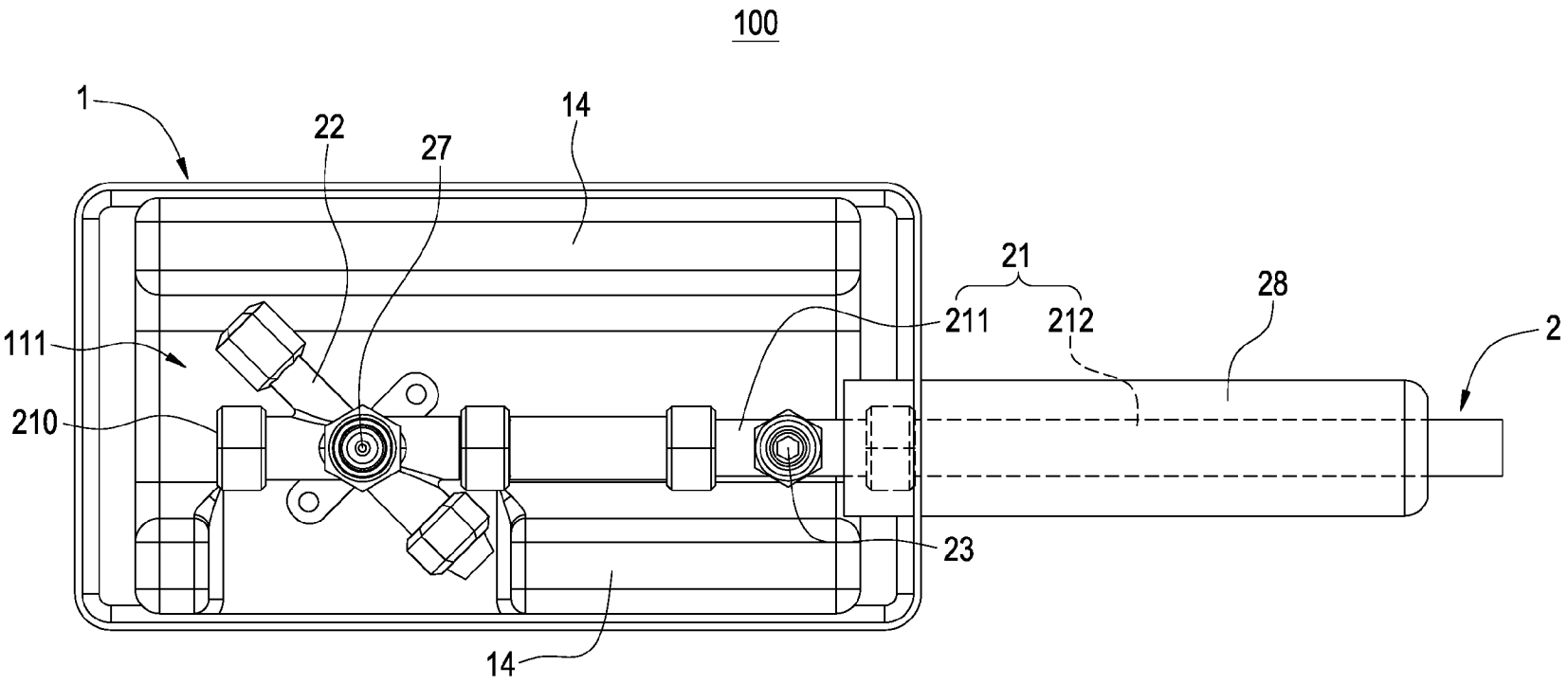
FIG. 6 is a front view of the refrigerant socket, in which the refrigerant socket is changed to use a single pipeline assembly and a single joint, according to the first embodiment of the present invention.

FIG. 6 shows a modified example (the cover body 12 and the partition 13 are omitted) according to the foregoing first embodiment of the present invention. In the modified example, the first embodiment is modified into a single unit type refrigerant socket 100. The single unit type refrigerant socket 100 includes the foregoing accommodating body 1 and only one set of pipeline assembly 2. The pipeline assembly 2 includes only one joint 27 (with any diameter matching to the indoor unit 800) as shown in the drawing. Certainly, in the modified example according to the first embodiment of the present invention, the pipeline assembly 2 can have plural joints with diameters different from one another (not shown in the drawings).

FIG. 7 is a schematic view showing the connection in regard to the air conditioner using the single unit type refrigerant socket 100 shown in FIG. 6, in which the single unit type refrigerant socket 100 is connected between the outdoor unit 600 and the indoor unit 800. Since the refrigerant socket 100 of the modified example includes only one pipeline assembly 2, it requires using two refrigerant sockets 100 to accomplish the connection. As shown in the drawing, the outer sections 212 of the refrigerant pipes 21 of the two refrigerant sockets 100 are respectively connected to the refrigerant outlet and the refrigerant inlet of the outdoor unit 600. The refrigerant outlet and the refrigerant inlet of the outdoor unit 800 are respectively connected to the joints 27 of the inner sections 211 of the two refrigerant sockets 100. Accordingly, the liquid-phase refrigerant of the outdoor unit 600 is conveyed to the indoor unit 800 via one of the refrigerant pipes 21 and one of the indoor unit refrigerant pipes 8. After performing the heat exchange in the indoor unit 800, the vapor-phase refrigerant is conveyed back into the outdoor unit 600 via the other one of the indoor unit refrigerant pipes 8 and the other one of the refrigerant pipes 21.

FIG. 7 is a schematic view showing the connection in regard to the air conditioner using the single unit type refrigerant socket 100 shown in FIG. 6, in which the single unit type refrigerant socket 100 is connected between the outdoor unit 600 and the indoor unit 800. Since the refrigerant socket 100 of the modified example includes only one pipeline assembly 2, it requires using two refrigerant sockets 100 to accomplish the connection. As shown in the drawing, the outer sections 212 of the refrigerant pipes 21 of the two refrigerant sockets 100 are connected to the refrigerant outlet and the refrigerant inlet of the outdoor unit 600, respectively. The refrigerant outlet and the refrigerant inlet of the outdoor unit 800 are connected to the joints 27 of the inner sections 211 of the two refrigerant sockets 100, respectively. Accordingly, the liquid-phase refrigerant of the outdoor unit 600 is conveyed to the indoor unit 800 via one of the refrigerant pipes 21 and one of the indoor unit refrigerant pipes 8. After performing the heat exchange in the indoor unit 800, the vapor-phase refrigerant is conveyed back into the outdoor unit 600 via the other one of the indoor unit refrigerant pipes 8 and the other one of the refrigerant pipes 21.

Regarding no waste of refrigerant, since the switch 23 can be used to block the flow of the refrigerant in the refrigerant pipe 21, to remove or install the indoor unit 800 for the above-mentioned reasons, it only needs to pump out the refrigerant inside a small section, of the refrigerant pipe 8, from the indoor unit 800 to the refrigerant socket 100 so as to substantially achieve the vacuum inside the small section. Moreover, the refrigerant in the outer section 212 of the refrigerant pipe 21, which is longer in length, does not need to be pumped out to achieve the substantially vacuum state. The refrigerant is blocked and limited between the switch 23 and the outdoor unit 600, thereby greatly reducing waste of the refrigerant and lower the possibility of incurring refrigerant leakage pollution. To install back the indoor unit 800, it only needs to connect the indoor unit refrigerant pipe 8 to the corresponding joints 24 to 26, then turn on the switch 23, and then the refrigerant is allowed to flow and the air conditioner can be turned on immediately to operate.

Situations other than the above-mentioned are for example the following which also achieve the above-mentioned effects: removing the indoor unit 800 to clean it then installing it back, or removing the indoor unit 800 for maintenance then installing it back.

Figure 8:
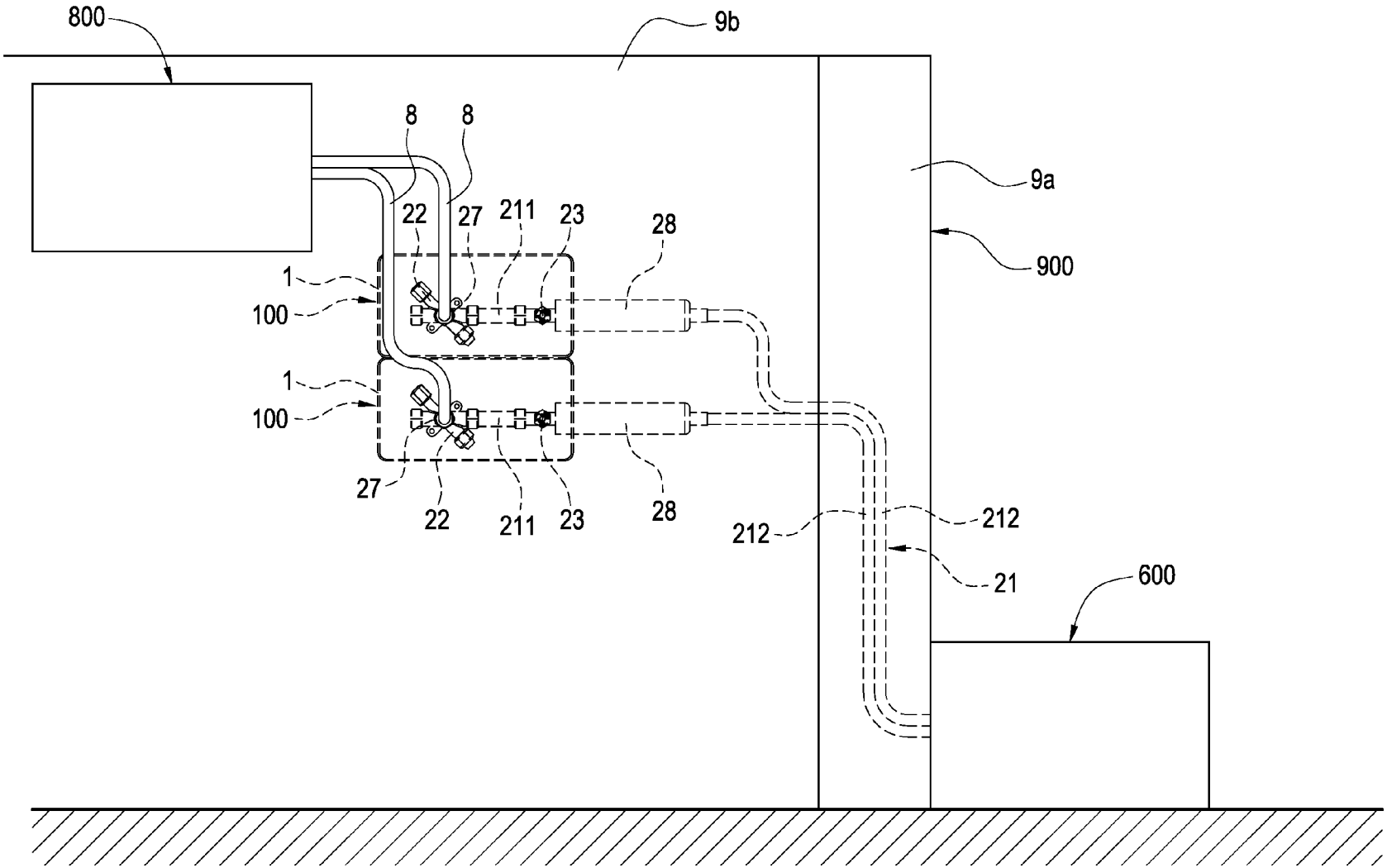
FIG. 8 is a schematic view of the air conditioner installed to a building according to FIG. 7 of the present invention.

FIG. 8 is a schematic view of the air conditioner installed to the building 900 according to the foregoing modified example of the first embodiment of the present invention. The building 900 includes a plurality of walls (including the walls 9*a* and 9*b*), the outdoor unit 600 is installed outside the building 900, one of the indoor walls of the building 900 have the plural refrigerant sockets 100 (the refrigerant sockets are installed in pairs, and each pair includes two of the refrigerant sockets) installed thereto, and the outer section 212 of the refrigerant pipe 21 is embedded in advance inside the walls 9*a* and 9*b* and pre-connected among the refrigerant outlet, the refrigerant inlet of the outdoor unit 600 and the plurality of refrigerant sockets 100. At this point, the workman only needs to install the indoor unit 800 to the wall 9*b* according to requirements, and then the two indoor unit refrigerant pipes 8 can be removably connected to the two joints 27 of one of the pairs of the refrigerant sockets 100, which makes the installation very easy, convenient, and fast.

Figure 9:
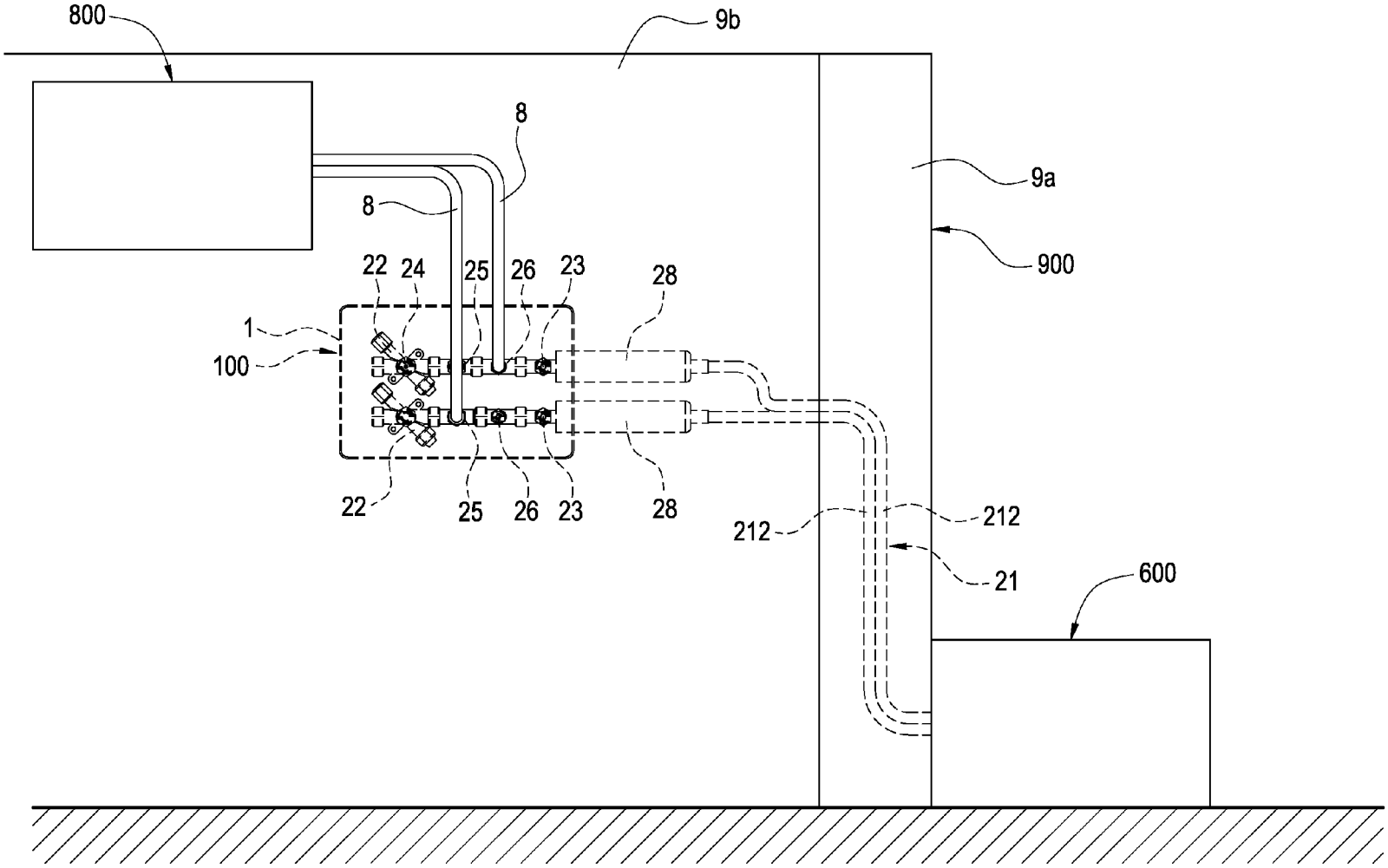
FIG. 9 is a schematic view of the air conditioner installed to the building according to FIG. 5 of the present invention.

FIG. 9 is a schematic view of the air conditioner installed to the building 900 according to the first embodiment (shown in FIG. 5) of the present invention. The refrigerant socket 100 of the present invention is already embedded in the indoor wall of the building 900, the outer section 212 of the refrigerant pipe 21 is embedded in advance in the walls 9*a* and 9*b* and pre-connected among the refrigerant inlet, the refrigerant outlet and the refrigerant socket 100. At this point, the workman only needs to install the indoor unit 800 on one (i.e. the wall 9*b*) of the walls, the two indoor unit refrigerant pipes 8 of the indoor unit 800 can be respectively and removably connected to a suitable one of the joints 25 and 26, which makes the installation easy, convenient, and fast.

Figure 10:
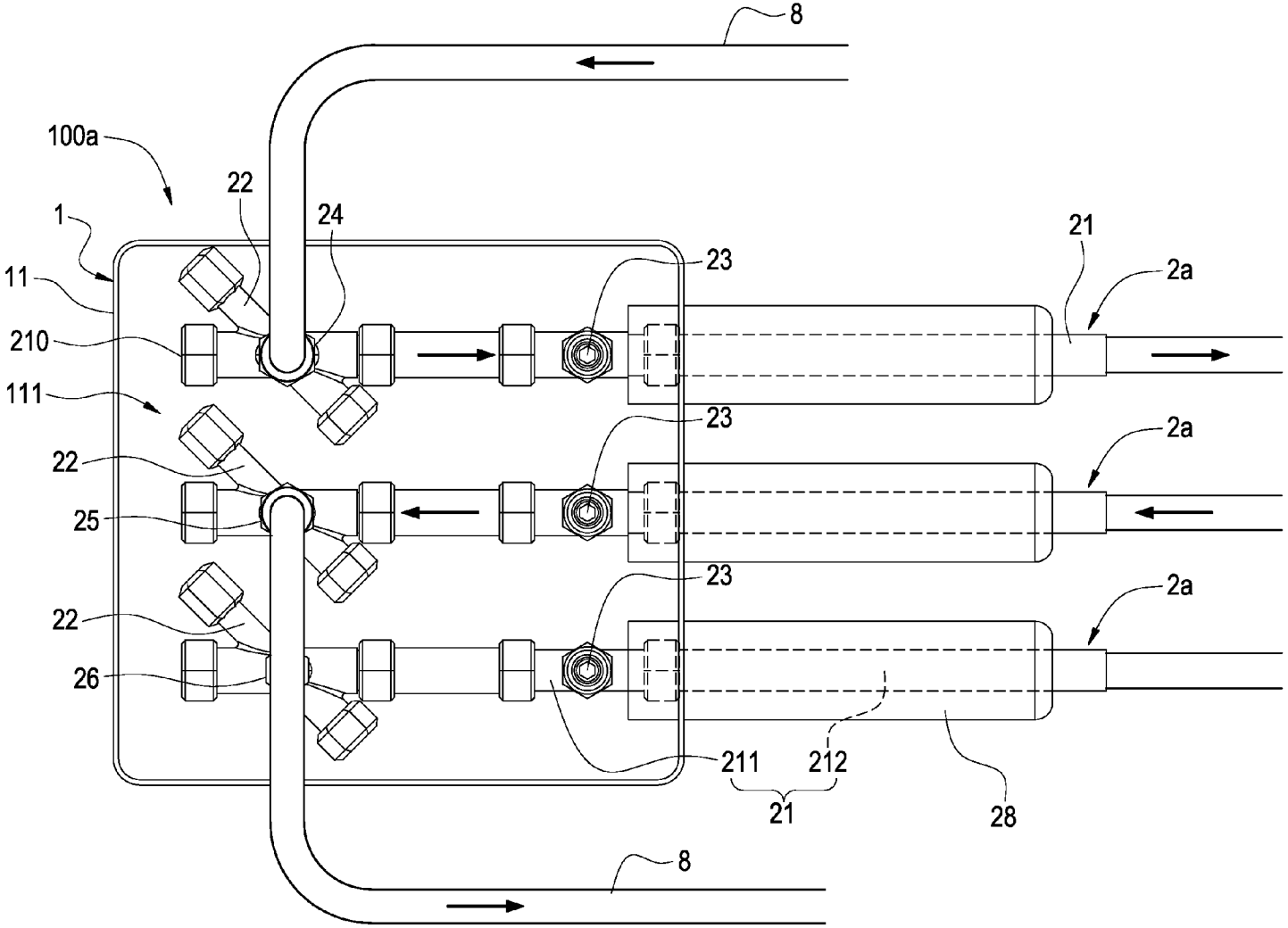
FIG. 10 is a schematic front view of a refrigerant socket according to the second embodiment of the present invention, which illustrating the flow state of the refrigerant after the refrigerant socket is connected to the indoor unit refrigerant pipe (the cover body and the partition are opened).

FIG. 10 shows a refrigerant socket according to the second embodiment of the present invention. The refrigerant socket 100*a* of the second embodiment is almost the same to the refrigerant socket 100 of the foregoing first embodiment. The difference lies in that the accommodating body 1 of the refrigerant socket 100*a* is connected to three pipeline assemblies 2*a*.

Each of the pipeline assemblies 2*a* has a different joint 24, 25 or 26 (these joints are different from one another in diameter; their diameters are ½ inch, ⅜ inch and ¼ inch sequentially, or are ¾ inch, ⅝ inch and ½ inch sequentially). The refrigerant socket 100*a* has three refrigerant pipes 21, and the outer sections 212 of the three refrigerant pipes 21 are pre-installed or embedded in advance inside the walls 9*a* and 9*b*.

Accordingly, referring to FIG. 7, when installing the indoor unit 800, the workman only needs to use any two pipeline assemblies 2*a* matching the indoor unit 800 for making the connections. The un-connected pipeline assemblies are shut off by means of the switch 23 and not in use. In other words, as shown in FIG. 10, when choosing to use the joint 24 with the diameter of ½ inch and the joint 25 with the diameter of ⅜ inch, the joint 26 with the diameter of ¼ inch is shut off and not in use. Further, when choosing to use the joint 24 with the diameter of ½ inch and the joint 26 with the diameter of ¼ inch, the joint 25 with the diameter of ⅜ inch is shut off and not in use (not shown in the drawings), and the rest may be deduced by analogy.

In summary, compared to conventional techniques, the present invention has the following effects: it only needs to pre-install the refrigerant sockets 100 and 100*a* to the wall, and connect in advance the refrigerant sockets 100 and 100*a* to the outdoor unit 600 via the outer section 212 of the refrigerant pipe 21, such that when installing the indoor unit 800 with any pipe diameter, the installation is very easy, convenient and fast by simply making the indoor unit refrigerant pipe 8 selectively and removably connected to the matching ones of the joints 24 to 26 (or 27) of the refrigerant sockets 100 and 100*a*. In other words, since the joints 24 to 26 (or 27) with different diameters respectively can match the indoor unit 800 of all kinds of cooling capacity, it only needs to select suitable joints 24 to 26 (or 27) to make the connections when installing the indoor unit 800 of different cooling capacity, and there is no need to remove the originally installed piping of the refrigerant pipe 21.

Furthermore, when the indoor room is intended for a different use, the cooling capacity is changed, the space design is changed, decoration is changed, brand-new decoration is required, or the position of the indoor unit 800 is changed, the connection can still be made via the refrigerant sockets 100 and 100*a* even if the diameter of the refrigerant pipe 21 cannot match the indoor unit 800, and thereby achieving effects as follows: no need to remove the original piping of the refrigerant pipe 21, no need to install new piping, no waste of piping materials, no waste of refrigerant, no damages to the structure of the building by repeatedly removing and re-installing piping (influences are more serious especially when the piping is pre-installed in the walls). In brief, even the diameter of the refrigerant pipe 21 cannot match the indoor unit 800, the connection can be made simply via the refrigerant sockets 100 and 100*a*.

Furthermore, the present invention also provides other effects: since the refrigerant sockets 100 and 100*a* are additionally disposed between the indoor unit 600 and the outdoor unit 800, it only requires the diameters of the joints 24 to 26 (or 27) to match the indoor unit 800. As to the outer section 212 of the refrigerant pipe 21, which does not need to be removed and replaced, there is no need to consider the size/diameter problem since it does not affect the coolness of the air conditioner. Certainly, the invention is embodied best when directly choosing to use the outer section 212 with a largest diameter.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A refrigerant socket, comprising:

an accommodating body having an accommodating space; and at least one pipeline assembly comprising:

a refrigerant pipe connecting to the accommodating body and having an inner section inside the accommodating space and an outer section outside the accommodating body, the inner section having a free end;

a switch located within the inner section and closer to a junction of the outer section and the inner section than the free end, the switch selectively allowing or blocking a flow inside the refrigerant pipe;

a refrigerant pumping pipe for pumping out refrigerant therein and communicating between the free end of the inner section and the switch, the refrigerant pumping pipe being connected to the joint closest to the free end as to pump out the refrigerant inside the inner section when the switch is blocking the refrigerant pipe to substantially achieve a vacuum; and a plurality of joints communicating between the free end of the inner section and the switch, wherein each of the joints has a different diameter.

2. The refrigerant socket of claim 1, wherein the at least one pipeline assembly is a plurality of pipeline assemblies, and the refrigerant pipe of each of the pipeline assemblies is connected to the accommodating body and has the inner section inside the accommodating space and the outer section outside the accommodating body.

3. The refrigerant socket of claim 2, wherein at least one joint of the plurality of joints of at least one pipeline assembly of the plurality of pipeline assemblies has a different diameter than the joints of at least one other pipeline assembly of the plurality of pipeline assemblies.

4. The refrigerant socket of claim 1, wherein the at least one pipeline assembly is a single pipeline assembly.

5. The refrigerant socket of claim 1, wherein at least one pipeline assembly is two pipeline assemblies, and the refrigerant pipe of each of the pipeline assemblies is connected to the accommodating body and has the inner section inside the accommodating space and the outer section outside the accommodating body.

6. The refrigerant socket of claim 5, wherein each of the joints within one of the pipeline assemblies has a different diameter.

7. The refrigerant socket of claim 1, wherein the accommodating body comprises a box body having the accommodating space and at least one cover body, the box body has an opening corresponding to the accommodating space, and the at least one cover body is in correspondence to the joints to cover the opening.

8. The refrigerant socket of claim 1, wherein the refrigerant pumping pipe is communicated with the inner section is at the free end.

9. The refrigerant socket of claim 1, wherein the refrigerant pumping pipe is a three-way pipe.

10. The refrigerant socket of claim 1, wherein the switch is a stop valve.

11. An air conditioner comprising:

an outdoor unit;

at least one indoor unit having an indoor unit refrigerant pipe; and at least one refrigerant socket, comprising:

an accommodating body including an accommodating space; and at least one pipeline assembly, the at least one pipeline assembly comprising:

a refrigerant pipe connecting to the accommodating body and having an inner section inside the accommodating space and an outer section outside the accommodating body, the inner section having a free end, and the outer section connecting to the outdoor unit;

a switch located within the inner section and closer to a junction of the outer section and the inner section than the free end, the switch selectively allowing or blocking, at a position where the switch is, a flow inside the refrigerant pipe;

a refrigerant pumping pipe for pumping out refrigerant therein and communicating between the free end of the inner section and the switch, the refrigerant pumping pipe being connected to the joint closest to the free end as to pump out the refrigerant inside the inner section when the switch is blocking the refrigerant pipe to substantially achieve a vacuum; and a plurality of joints communicating between the free end of the inner section and the switch, the indoor unit refrigerant pipe of the at least one indoor unit being connected to the joints, wherein each of the joints has a different diameter.

12. The air conditioner of claim 11, wherein the at least one pipeline assembly is a plurality of pipeline assemblies, and the refrigerant pipe of each of the pipeline assemblies is connected to the accommodating body and has the inner section inside the accommodating space and the outer section outside the accommodating body.

13. The air conditioner of claim 12, wherein at least one joint of the plurality of joints of at least one pipeline assembly of the plurality of pipeline assemblies has a different diameter than the joints of at least one other pipeline assembly of the plurality of pipeline assemblies.

14. The air conditioner of claim 11, wherein the at least one pipeline assembly is a single pipeline assembly.

15. The air conditioner of claim 11, wherein at least one pipeline assembly is two pipeline assemblies, and the refrigerant pipe of each of the pipeline assemblies is connected to the accommodating body and has the inner section inside the accommodating space and the outer section outside the accommodating body.

16. The air conditioner of claim 15, wherein each of the joints within one of the pipeline assemblies has a different diameter.

17. The air conditioner of claim 11, wherein the accommodating body comprises a box body having the accommodating space and at least one cover body, the box body has an opening corresponding to the accommodating space, and the at least one cover body is in correspondence to the joints to cover the opening.

18. The air conditioner of claim 11, wherein the refrigerant pumping pipe is communicated with the inner section is at the free end.

19. The air conditioner of claim 11, wherein the refrigerant pumping pipe is a three-way pipe.

20. The air conditioner of claim 11, wherein the switch is a stop valve.

21. The air conditioner of claim 11, wherein the indoor unit refrigerant pipe comprises a butt joint, and the indoor unit refrigerant pipe is removably connected to the joints of the at least one refrigerant socket by using the butt joint.

* * * * *